United States Patent [19]

Soquenne

[11] 3,973,818

[45] Aug. 10, 1976

[54] MULTI-PURPOSE PREFABRICATED ELECTRICAL INSTALLATION

[76] Inventor: Maurice Soquenne, Residence du Lac, 1 Esplanade de Collioure, 93330 Neuilly-sur-Marne, France

[22] Filed: Dec. 5, 1973

[21] Appl. No.: 422,091

[30] Foreign Application Priority Data

Dec. 7, 1972 France ..... 72.43495
Oct. 10, 1973 France ..... 73.36152

[52] U.S. Cl. ..... 339/22 B; 200/50 B; 317/113; 339/24

[51] Int. Cl.[2] ..... H01R 13/60

[58] Field of Search ..... 339/20, 21 R, 22 R, 339/22 B, 24, 75 R, 75 M, 193 P; 317/112, 113; 200/50 B, 51, 51.07

[56] References Cited

UNITED STATES PATENTS

| | | | |
|---|---|---|---|
| 2,906,808 | 9/1959 | Krauss | 339/22 B |
| 3,531,758 | 9/1970 | Blumkin | 339/22 B |
| 3,757,273 | 9/1973 | Hesse | 339/21 R |
| 3,760,133 | 9/1973 | Howard | 339/21 R |
| 3,786,394 | 1/1974 | Koenig et al. | 339/22 B |
| 3,794,955 | 2/1974 | Bertrams | 339/21 R |

*Primary Examiner*—Roy Lake
*Assistant Examiner*—Neil Abrams
*Attorney, Agent, or Firm*—William A. Drucker

[57] ABSTRACT

The invention relates to a prefabricated electrical supply device comprising an earthed conductor duct including a sheath which is formed generally into the shape of a "G", and which preferably contains, on only one side, an electrical insulating member provided with slots parallel to the back of the sheath at the bottom of which slots are situated two main conductors and auxiliary conductors. The device includes at least one junction-box incorporating a pivotable shaft which, in operation, is generally perpendicular to the back of the sheath, which serves both to mechanically secure the junction-box to the sheath, and also to make the electrical connections for power and remote control via contact members and a printed circuit board.

4 Claims, 37 Drawing Figures

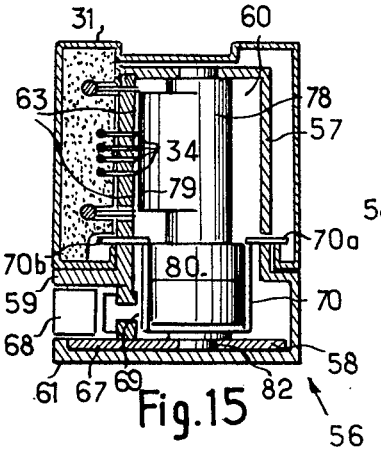
Fig.15
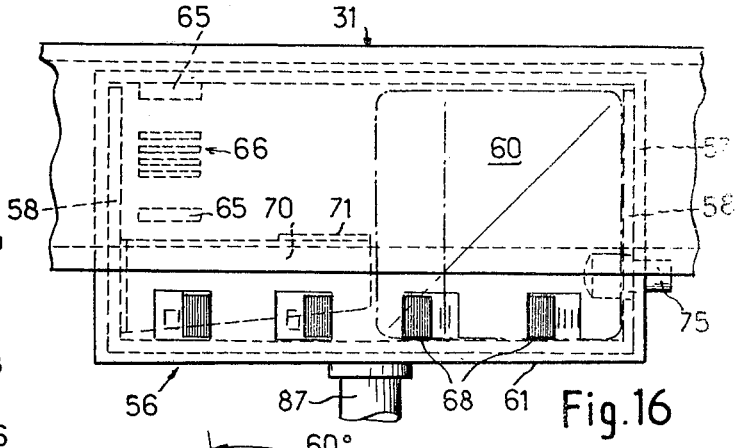
Fig.16
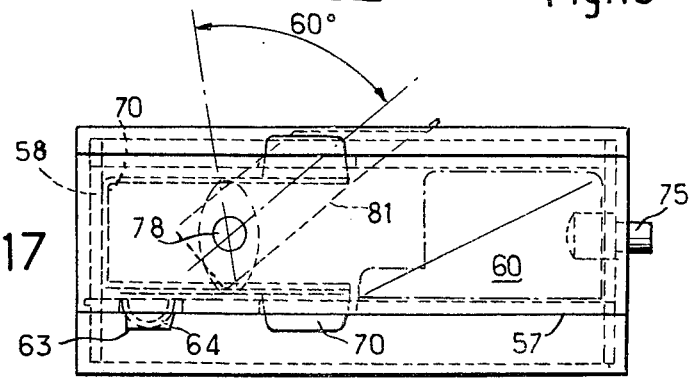
Fig.17
Fig.18
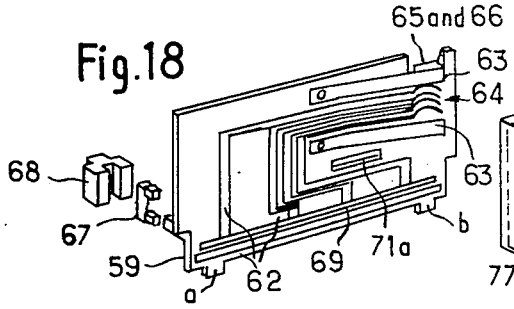
Fig.19
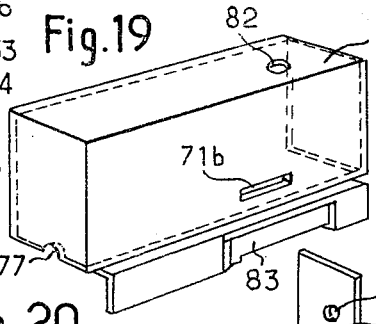
Fig.22
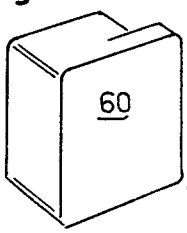
Fig.23
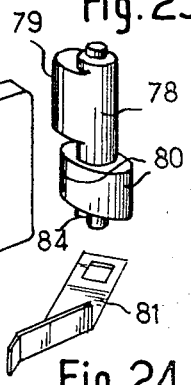
Fig.24
Fig.20
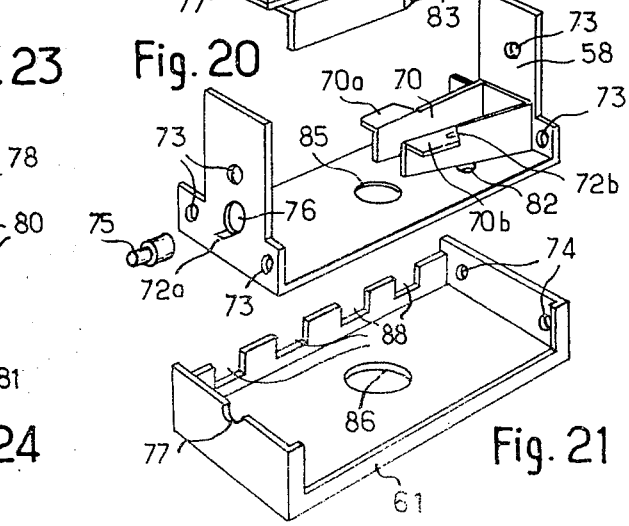
Fig.21

36
37
39d
40
41
43
44
45
46
47
48
49
50
51
52

MULTI-PURPOSE PREFABRICATED ELECTRICAL INSTALLATION

The present invention relates to electrical ducting which serves both as a mechanical support for, and as a source of current supply to, various electrical accessories, or pieces of equipment, such as spotlights, fluorescent tubes, fans, heaters, supply sockets, and even loud-speaker or public address systems. There are already various types of channelling in existence which are used with take-off points, and at the same time serve as a mechanical support.

The present invention relates to a system intended for voltages from 120 to 360 volts and for currents up to 40 amps. Since the components are factory-made, it is very much easier to install them.

The invention consists in an electrical supply device comprising a shaped duct having a flat back suitable for fixing to a wall, the duct including an open metal sheath which partly encloses at least one insulating member for protecting conductors, and at least one detachable junction-box which can be fitted anywhere along the duct and which forms a mechanical support for a piece of electrical equipment, two of the said conductors carrying power and the said junction-box being capable of being partly inserted into the opening in the sheath, and when so inserted being located against a supporting surface of the sheath, and being locked in place mechanically, the device being characterised by at least two auxiliary conductors of relatively small cross-section which are capable of providing a plurality of switching functions under remote preselector control, the said auxiliary conductors being situated at the bottom of preformed slots in the insulating member, the plane of which slots is parallel to the back of the metal sheath, the junction-box incorporating at least one pivotable contact member the axis of which is perpendicular to the flat back of the sheath and which is capable of being fitted into the opening in the sheath, the contact member having tongues parallel to the plane of the slots which enter the slots when the contact member is pivoted after the junction-box has been fully inserted, this pivotal movement producing electrical connection with respect to both the main and auxiliary conductors.

In one embodiment, a safety or earth conductor is housed at the bottom of the sheath for the conductors, and the connectors of any accessory make contact with this conductor before the accessory is even attached mechanically, which provides an extra measure of safety if the electrical supply should accidentally still be live.

In another preferred embodiment, the conductor channel or duct, such as the sheath, insulating member and/or the slots in the insulating member are assymetrical, which eliminates the need for a fool-proofing device. The accesories used with the channel or duct, being themselves assymetrical, can thus only be fitted one way round.

The insulating member, which is enclosed in the sheath of the channel or duct and contains two main conductors (line P and neutral N) and preferably at least four auxiliary conductors (C), occupies only one side of the shaped duct, and the result is a saving in manufacture.

The junction-box, or adaptor, contains a printed-circuit board which makes wiring-up unnecessary, and also contains four preselector switches.

A considerable proportion of the junction-box is housed inside the duct itself, in particular the remote-controlled switching device, the mechanical fastenings, the tongues of the main contacts, the four control contacts, and a single rotating member having cams which serve both for the mechanical attachment and for closing the said contacts.

The piece of equipment to be supplied is earthed through the tongue which provides the mechanical attachment, the duct or conduit itself serving as a safety conductor.

It is easy to interconnect pieces of duct which have been cut to length by using various plug-in components such as extenders, elbows, T-pieces and cross-pieces, and connecting blocks.

This preferred embodiment is thus characterised by a conductor duct in which the sheath has a non-central opening formed by two lower folds of different widths which extend into two internal folds of equal height forming a bearing surface for locking in place a junction-box or adaptor which rests against the lower folds of the said sheath, the sheath being earthed, and earthing the said piece of equipment which it supplies as a result of the locking tongues of the junction-box being rotated, the said sheath enclosing a single insulating member which contains two slots parallel to the back of the duct which hold two main power-carrying conductors, and at least four narrower slots holding the said auxiliary conductors.

This preferred embodiment is further characterised by a single rotatable contact member, the axis of which is perpendicular to the back of the sheath, and by a junction-box which incorporates a printed-circuit board interposed between the four auxiliary conductors and their four preselector switches.

In order that the invention may be more readily understood, reference will now be made to the accompanying drawings which show examples of an embodiment thereof, and in which.

Figure 8:
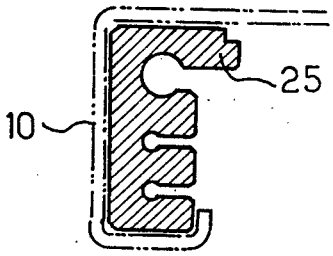
Figure 9:
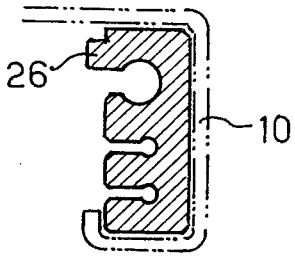
Figure 10:
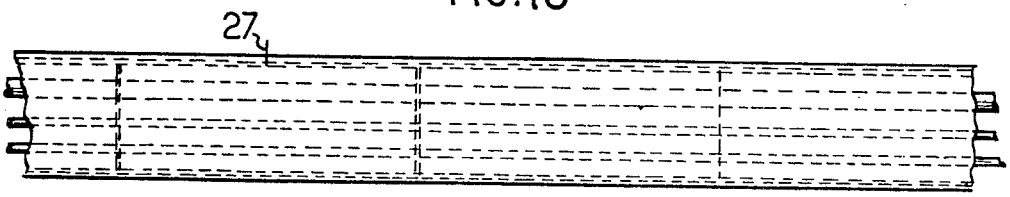
Figure 11:
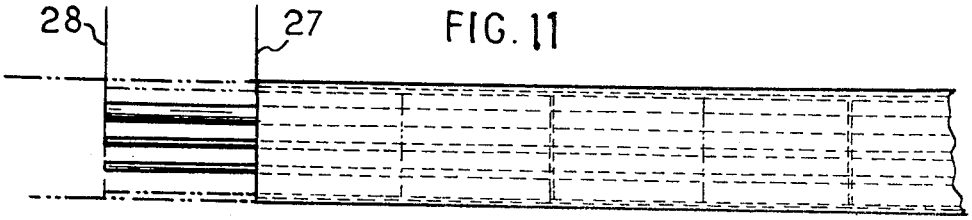
Figure 13:
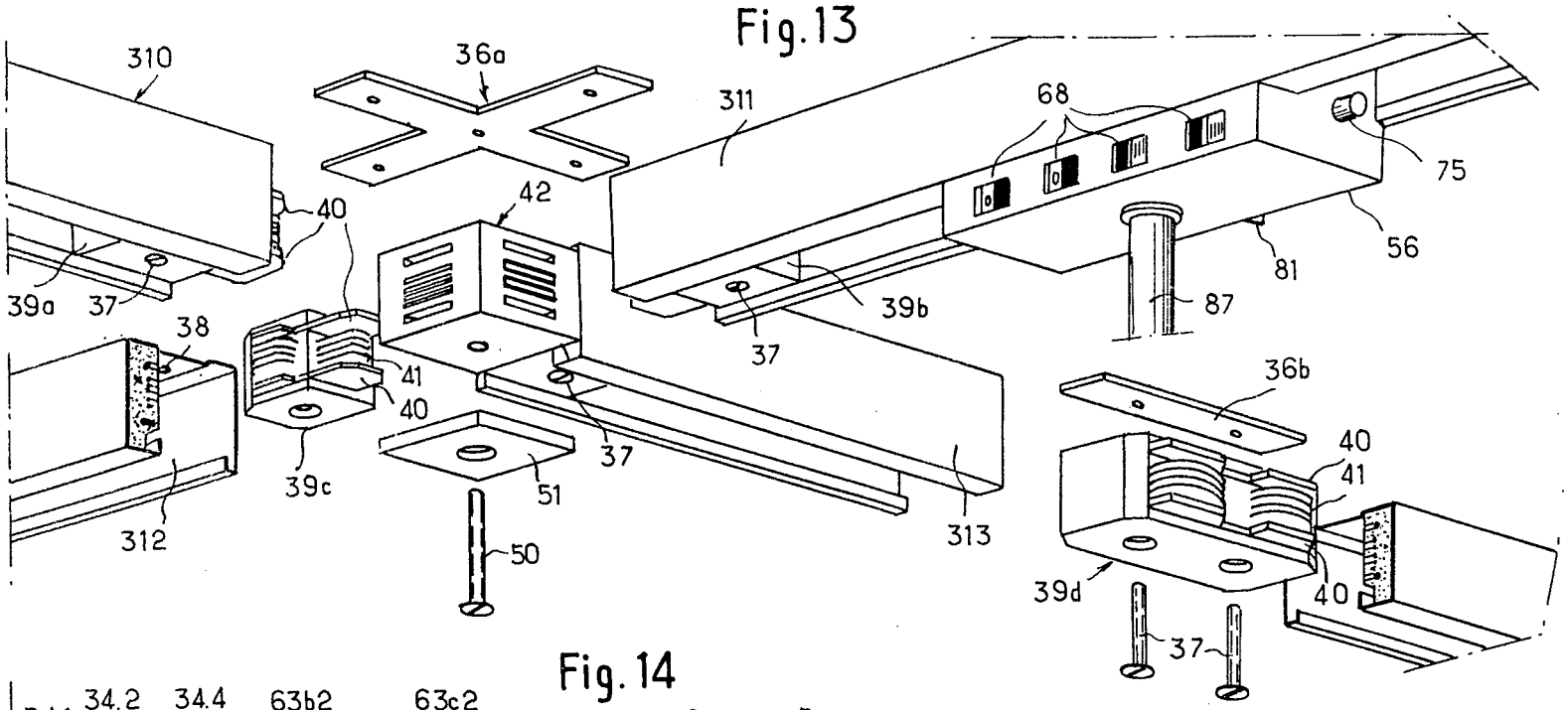
Figure 12:
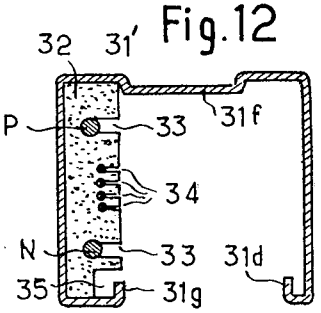
Figure 14:
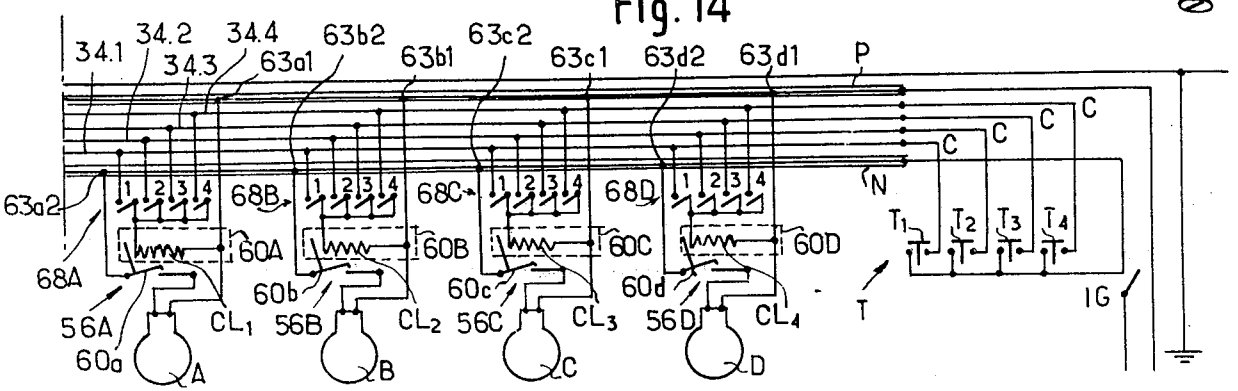
Figure 28:
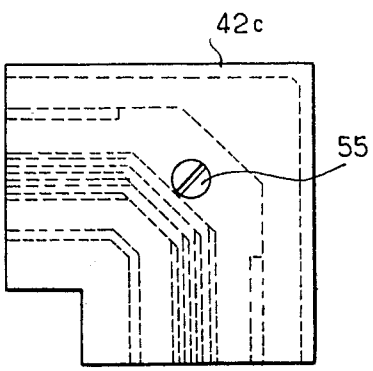
Figure 30:
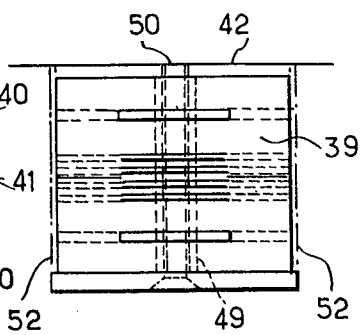
Figure 26:
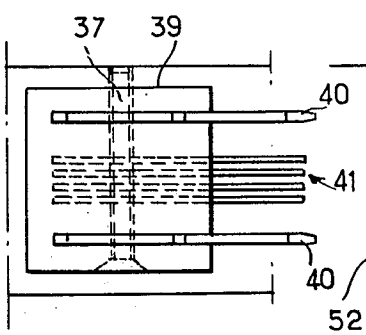
Figure 25:
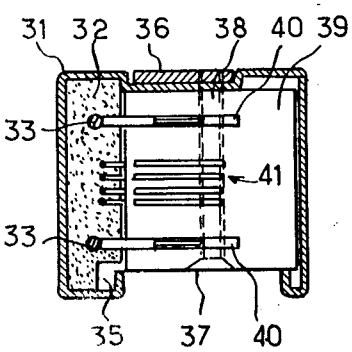
Figure 29:
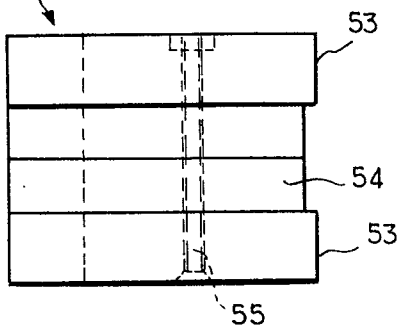
Figure 31:
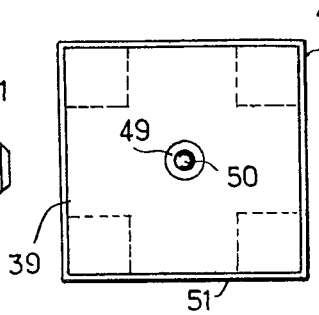
Figure 27:
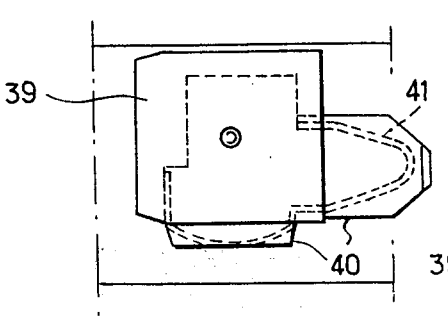
Figures 32, 33, 34, 35, 36, 37:
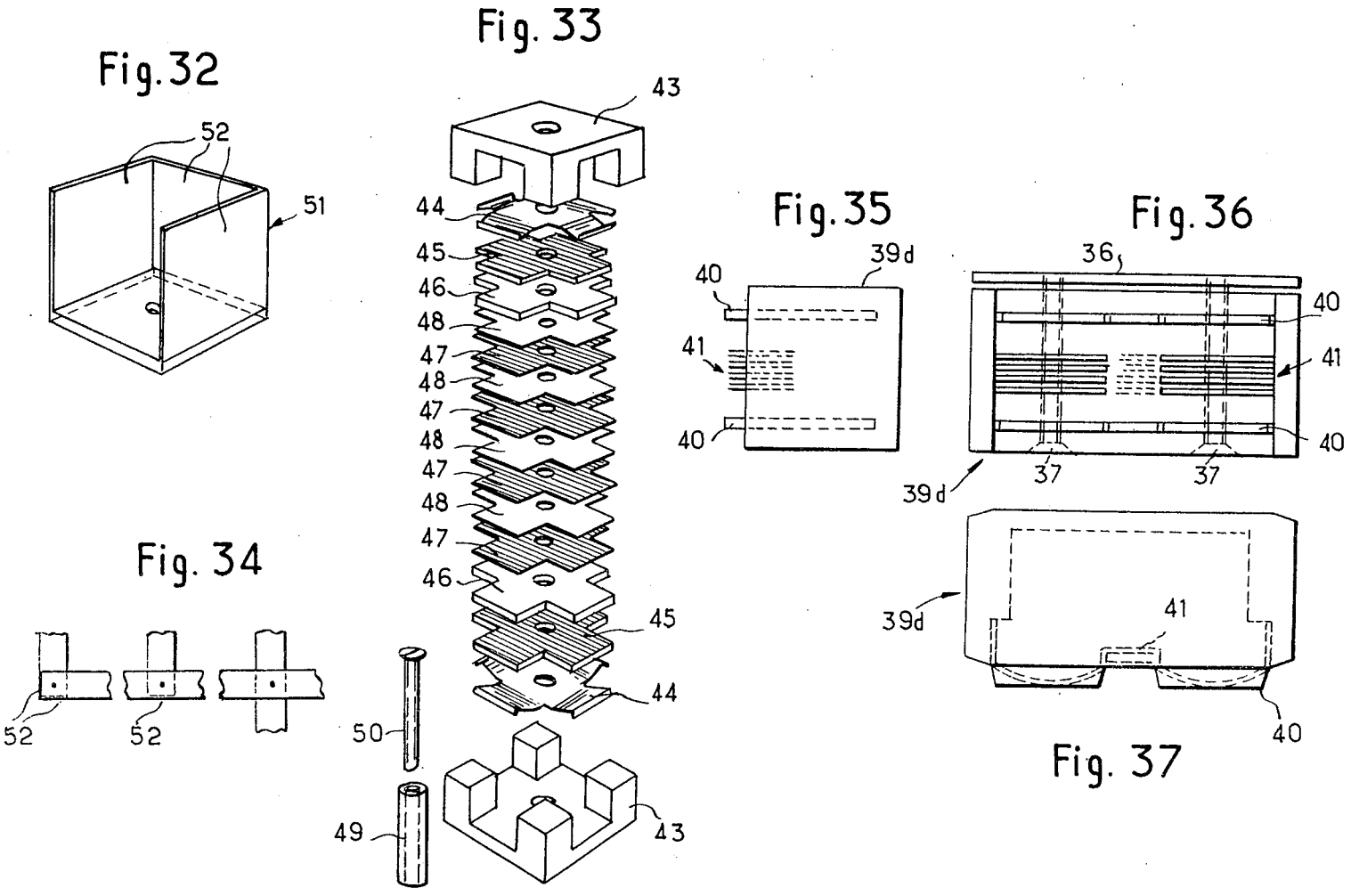

FIGS. 8 and 9 are cross-sections through the insulating members (8 and 9) of FIGS. 12 and 13;

FIGS. 10 and 11 are diagrams showing how the duct may be cut;

FIG. 12 is a cross-section through a preferred embodiment of a conductor duct;

FIG. 13 is a general exploded perspective view of the components of which a system embodying the duct of FIG. 12 is made up;

FIG. 14 is an overall circuit diagram for the system;

FIG. 15 is a cross-section through an adaptor partially housed in a duct as shown in FIG. 13;

FIGS. 16 and 17 show the same adaptor, respectively, in elevation and plan;

FIGS. 18 and 24 are various exploded perspective views of the components of this same adaptor;

FIG. 25 is a cross-section, and FIGS. 26 and 27 are elevational and plan views, respectively, of a plug-in connector housed in a duct as shown in FIG. 12;

FIGS. 28 and 29 are two diagrams of an elbow for making connections in two mutually perpendicular planes;

FIGS. 30 and 31 are two corresponding diagrams of a connector block;

FIG. 32 is a perspective view of a cover for an elbow for connections made in only one plane;

FIG. 33 is an exploded perspective view of the components of a connector block;

FIG. 34 is a diagram showing three ways in which part 51 may be used; and FIGS. 35, 36 and 37 are three diagrams of a connector for making a straight joint.

Figure 1:
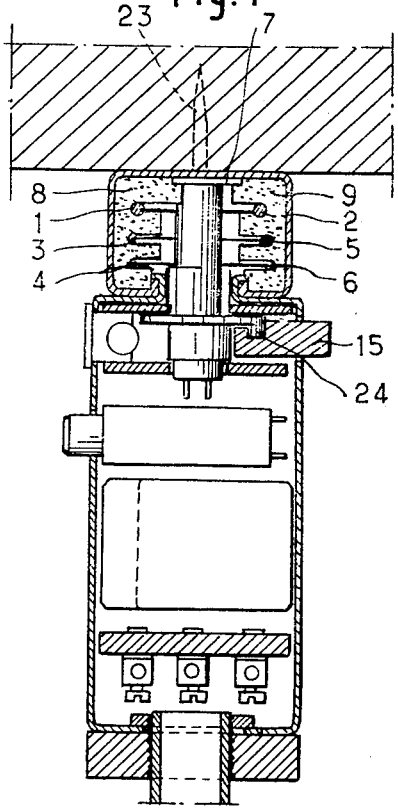
FIG. 1 is a transverse section of a conductor duct or channel (fixed to a ceiling), which supports a junction-box.

In FIG. 1 can be seen the main conductors 1 and 2, the control or auxiliary conductors 3, 4, 5 and 6 and the safety or earth conductor 7 which is electrically connected to the sheet steel casing or sheath 10 in FIGS. 5, 6, 7, 8 and 9. As will be apparent from FIG. 1 the sheath has a generally inverted "U" or "G" shape or profile in cross-section with the lower or free ends of the limbs of the "U" or "G" folded inwardly towards each other to form flanges.

The insulating members 8 and 9 are made as required from a suitable material, and in this embodiment from a refractory material such as glass, porcelain, or some other material which will withstand temperatures between 1,000° and 1,500°C. Copper conductors are known to melt at 1093°C and the steel casing or sheath 10 at 1600°C. The conductors will, therefore, be protected until they melt.

FIGS. 6 and 8, and 7 and 9, are perspective sectional views of the complementary insulating members 8 & 9 enclosed in their steel sheath 10. These members are short in length, being preferably 50 mm long, and their top parts 25 and 26 are different so that the conductor duct or conduit is non-symmetrical and there is, therefore a right and a wrong orientation for the junction-boxes to be attached thereto and which serve as supports for pieces of equipment. The conductors are located in part-circular enlargements or seatings at the transversely outer ends of inwardly opening slots in both insulating members. The preferred dimensions shown for this embodiment allow a clearance of 0.5 mm in the shaped or profiled steel sheath 10 and allow the conductors to slide freely in their seatings after having been a tight fit in their respective slots when being inserted.

FIGS. 10 and 11 are side-views of a conduit or duct enclosing a series of adjoining insulating members. Reference numeral 27 represents a line along which the shaped steel sheath is cut, and the gap between 27 and 28 represents the distance, equal to one half their length, by which the insulating members are moved apart, thus leaving 25mm of bare conductors to which connections may be made.

Figure 3:
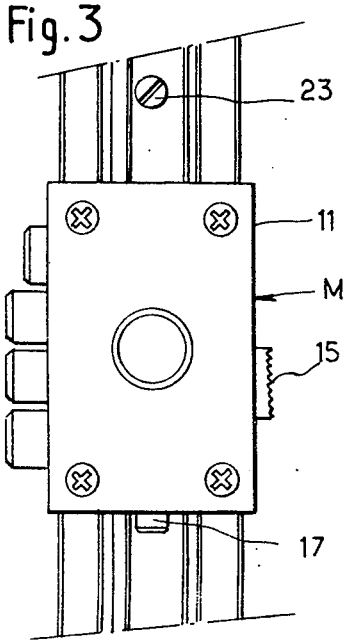
FIG. 3 is a plan view of the same combination.
Figure 5:
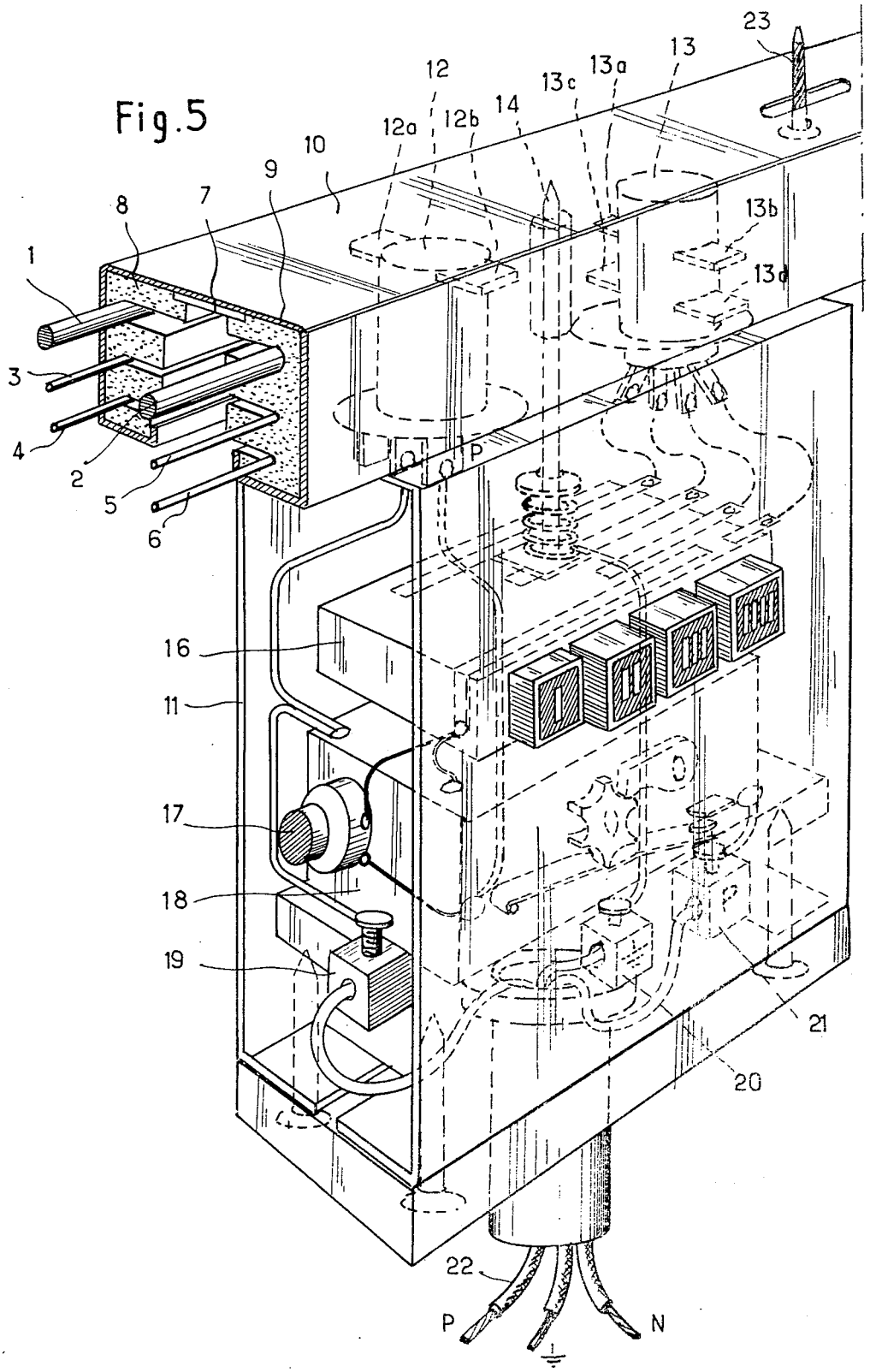
FIG. 5 is an "X-ray" perspective view of the combination formed by the conductor duct and the junction-box, the latter serving as a support for a piece of equipment which it supplies, the piece of equipment finishing, in this embodiment in a tube.
Figure 6:
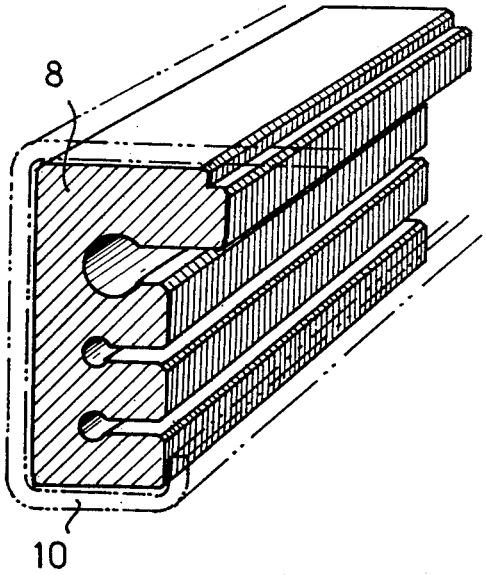
FIGS. 6 and 7 show, respectively, the one and the other of the two complementary insulating members (8 and 9)
Figure 7:
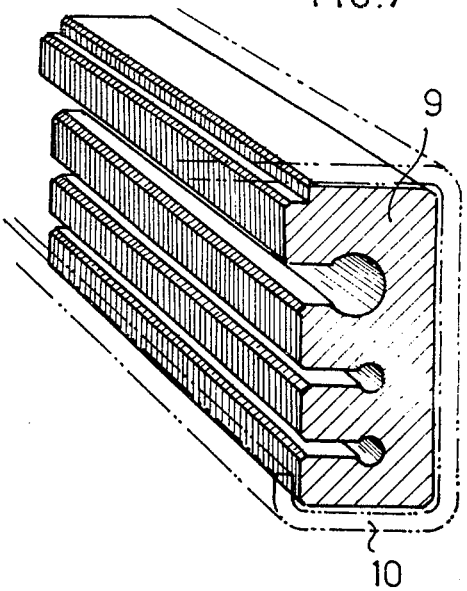

The whole device or duct can be fixed to any wall or ceiling by means of screws 23 (FIGS. 1, 3, 5).

Figure 2:
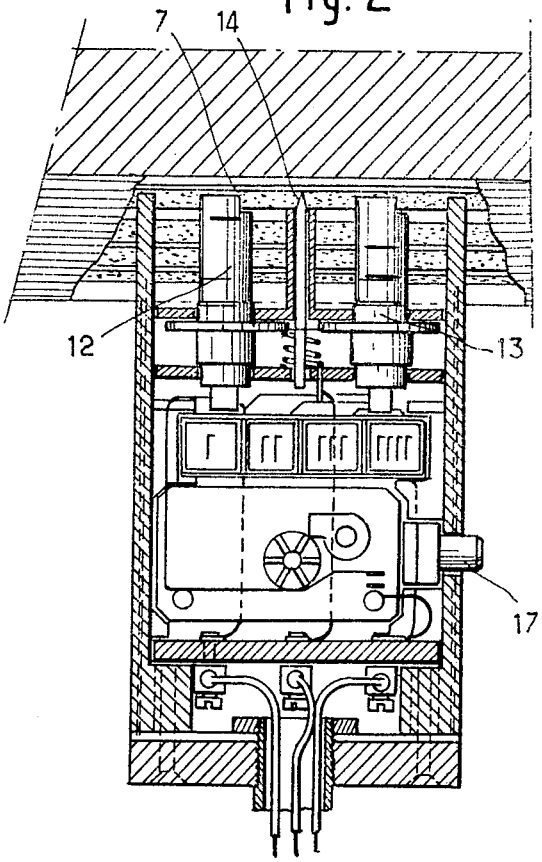
FIG. 2 shows the same combination in longitudinal section.

The junction-box 11 (FIGS. 2 and 5) is held in position against the edges or flanges of the sheath of the conductor duct by sheet-steel flanges which are themselves held in position by two contact members, one 12 for Line and Neutral, and the other 13 for the four control or auxiliary conductors.

Contact with the safety conductor 7 is provided by a resiliently mounted contact 14 which touches the casing before any other contacts are made.

Figure 4:
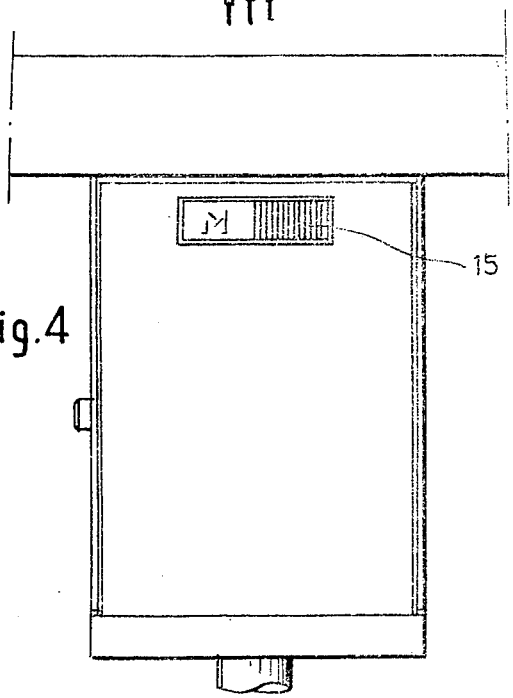
FIG. 4 is a side view of the combination from the side of the junction-box on which the "Off/On" switch is situated, FIG. 4 being on the same scale as FIGS. 1 to 3.

The junction-box is attached and connected up by means of an "On/Off" press-button 15 (FIGS. 1, 3 and 4) which is coupled to the contact members 12 and 13 by means of a peg 24, and which, upon actuation, causes transverse tongues fixed to the contact members respectively 12*a*, 12*b* and 13*a*, 13*b*, 13*c*, 13*d* to pivot into position in the slots as shown in FIGS. 5.

The use to which the piece of equipment mounted on the junction-box is to be put can be selected by means of a four-button selector 16 each button corresponding to one control channel, which transmits a control signal to a known type of remote-controlled switching device 18, which is not described, and which can itself be "changed over" by a further signal from a button 17.

Thus, when the piece of equipment which is to be supplied is fitted it can be connected to three terminals: Line 21, Neutral 19 and Earth 20.

The switch positions can be set during operation, and their settings can be altered indefinitely.

In FIG. 12, reference numeral 31 refers to the conductor duct, and 32 refers to the insulating member which is held in position on the left-hand side of the duct by a slight relief 31' in the back of the non-symmetrical duct, the duct being of a generally square shape and having an opening at the bottom, the centre of which is off-set to one side. The opening is formed by two lower folds or flanges of different widths at the right and left, and by upstanding internal end portions 31*g* and 31*d* which are of the same height, and which are provided to secure the junction-box in place mechanically.

Parallel to the back 31*f* of the duct, the insulating member has two main slots 33 in which are housed two power-carrying conductors P and N, and narrower slots 34 in which are housed four auxiliary conductors C.

The insulating member 32 also has a recess 35 leaving a space for a mechanical device 70 (see FIG. 15) for attaching an adaptor, as will be described below.

In FIG. 13, there are shown two types of mechanical connector plate, one of which 36*a* is cruciform and the other of which 36*b* is elongated. These plates ensure that the conductor duct has a continuous earth. Two other types, which are T-shaped and L-shaped can be derived from the type of plate 36*a* by removing one or two arms of the cross. Fixing holes, which are shown in the arms of the plates, co-operate with screws such as 37 and 50 to make the connections. The arms of the plates are positioned substantially in the depressions 31f shown in FIG. 12. To the left of FIGS. 13, at 38, can be seen an aperture in the sheath for a screw 37 to pass through.

At 39*a* and 39*b* in FIG. 13 can be seen two two-way end connectors for making flat or horizontal connections, which connectors are mounted in two ducts 310 and 311 at right angles to each other. Connector 39*a*, is fitted into a third duct 312 which forms a continuation of that containing the connector 39*b*, while a fourth duct 313, which forms a continuation of that containing connector 39*a*, is already plugged into a connector block 42 to which all the four ducts forming the cruciform configuration may be connected in the same way.

In FIG. 13 there is also shown at 39*d* a connector for straight joints which enables connections to be made in a straight line without the need for a connector block such as 42.

Main brass contacts, which are 2 mm thick, are shown at 40, and the auxiliary contacts, which are made of 0.8 mm diameter brass wire, are shown at 41. These parts can be better seen in FIGS. 26 and 27, which show a connector 39 (similar to 39*c* in FIG. 13), and in FIG. 31 which shows the said connector when inserted in a duct. FIGS. 35, 36, 37 are three different views of a connector (similar to 39d in FIG. 13) for making straight joints.

The block 42 for making flat or horizontal corners or right angle joints, straight joints and T joints, is shown in perspective in FIG. 13 together with its cover 51 and the screw 50 for attaching it to the plate 36*a*. In FIGS. 30 and 37, which are, respectively, adjacent to FIGS. 26 and 27, the block 42 is shown in elevation and plan, FIGS. 30 and 31 show how a connector 39 can be fitted into a connector block 42. In FIGS. 30 and 31, as well as in the exploded perspective view of a connector block 42 in of FIG. 33, it can be seen that the screw 50 is enclosed in an insulating sleeve 49 before it is used to trap a stack of perforated parts, all of which are cruciform and some of which are insulators (46 and 48) while others (45 and 47), made for example, of brass, are conductors, between upper and a lower housing-half 43, which are moulded from an insulating material. The arms of the two end parts 44 (FIG. 33) are dished to form springs. The stack is enclosed in a cover 51 (FIG. 32), the walls 52 of which may be cut away to suit the directions in which connections are to be made, a diagram of the walls which need to be retained being shown in FIG. 34, in which there are seen, from left to right, two walls 52 for a corner, one wall for a T, and no walls for a cruciform connection.

FIGS. 35, 36 and 37, show the contacts 40 and 41 of a connector 39*d* for straight joints whereas FIGS. 25, 26 and 27 show the contacts 40 and 41 of a two-way end connector 39. It can be seen that, in both types of connectors, the contacts for the auxiliary conductors are made from flexible wires 41 formed into loops, while the main contacts 40, which are necessarily thicker, could not possibly have the desired flexiblity and are therefore rigid. They are therefore pressed against the main conductors P and N in the slots 33 (FIG. 12) by resilient means inside the connector, which means are not shown, to simplify the Figures. The contacts have a certain amount of play about the axis of each screw 37 and a pressure spring is provided, threaded onto a tab cut into the brass tongue on the inside.

FIGS. 28 and 29 show two views of a "biplanar elbow" type of connector 42*c* which is constructed on similar principles to the connecting block 42 shown exploded in FIG. 33. In FIG. 29 are shown merely the two insulating housing-halves 53, which leave a space at 54 on both sides of the corner for an angled plate to make a mechanical earth connection. A fixing screw 55 holds the whole connector together.

There will now be described, using FIGS. 15 to 24, the various components of the adaptor 56 which has already been shown in FIG. 13 mounted in a duct.

57 is a moulded housing having projections a and b (FIGS. 15, 16, 17, and 19), 58 is a chassis made of 2 mm. sheet metal (FIGS. 15, 16, 17 and 20), 59 is a moulded contact support carrying a printed circuit 62 (FIGS. 20, 15 and 18), 60 is a remote-controlled switching device (FIGS. 16, 17 and 22), 61 is a moulded cover (FIGS. 20, 14, 15, 16 and 21), 63 are the main contacts (FIGS. 15, 17 and 18), 64 are the brass auxiliary contacts which are soldered onto the printed circuit 62 (FIGS. 20, 14, 15, 17 and 18), 65 and 66 are cut-outs for the main and auxiliary contacts (FIGS. 16, 18); 67 are brass switch contacts (FIGS. 15 and 18); 68 are moulded switches for making settings or programming (FIGS. 15, 16 and 18); 69 is a slideway for the switch contacts 68 and 67 (FIGS. 15 and 18); 70 is a spring-clip welded to the chassis 58 (FIGS. 15, 16, 17 and 20) which serves to attach the adaptor mechanically; 71 is a cut-out for the spring-clip in parts 57 and 59 (FIGS. 16, 18 and 19); 72*a* and 72*b* are the slots in the base of the chassis 58 which hold the contact support 59 (FIG. 20); 73 are six holes to take projections on the moulded housing 57 and cover 61 (FIGS. 20 and 21); 75 is a moulded change-over button for the remote-controlled switching device (FIGS. 13, 16, 17 and 20); 76 is a hole for the button 75 to pass through (FIG. 20); 77 are the cut-aways for the button to pass through the housing 57 and the cover 61 (FIGS. 19 and 21); 78 is a moulded cam-shaft (FIGS. 15 and 23) and 79 is a lobe on the cam-shaft for the contacts 64 and 63, while 80 are lobes which lock the mechanical attachment 70 (FIGS. 15, 16, 17 and 20); 81 is a lever made of 1 mm. sheet metal (FIGS. 13, 17 and 24) which operates the cam-shaft 78; 82 are holes for lining-up the cam-shaft 78 in the housing 57 and the chassis 58 (FIGS. 15, 19 and 20); 83 is a recess in the housing 57 to take the lever 81 (FIG. 19); 84 is a square shoulder for the lever 81 (FIG. 23); 85 is a fixing hole in the chassis 58 for attaching a piece of lighting equipment 87 (FIG. 13); 86 is a hole in the cover 61 into which the said piece of lighting equipment fits (FIG. 21); 88 are castellations for the switches 68 (FIG. 21).

It can be seen that, when an adaptor 56 is fitted into a duct 31, turning the lever 81 through 60° results in a corresponding rotary movement of the cam-shaft. The latter spreads apart the arms of the spring-clip of the mechanical attachment 70 which bear on the folded edges 31*g* and 31*d* of the metal sheath of the duct (FIG. 12) and secure the adaptor mechanically. At the same time, the cam lobe 79 moves both the main and auxiliary contacts 63 and 64 into engagement.

Moving one or more of the four switches 68 then allows the adaptor to be set to $2^4$ (i.e. 10) switching combinations. FIG. 14 shows the overall circuit diagram of the installation. Four adaptors 50*a*, 50*b*, 50*c*, 50*d*, of which only the electrical coupling is shown, carry respective lamps A, B, C, D which represent symbolically any piece of equipment whatever, which may be in use. The lamps are directly coupled to the P supply conductor through respective fixed contacts $63a_1$, $63b_1$, $63c_1$ and $63d_1$ built up as is contact 63 of FIGS. 15, 18 or contact 12b of FIG. 5, while they are coupled to the N conductor through respective fixed contacts $63a_2$, $63b_2$, $63c_2$ $63d_2$ and mobile contacts 60*a*, 60*b*, 60*c*, 60*d* of remote controlled devices 60A, 60B, 60C, 60D such as 60 (FIGS. 16, 17, 22) or 18 (FIG. 5) comprising, e.g. a coil as shown here which, upon being energized, puts on the mobile contact. The coils of devices 60A, 60B, 60C, 60D are coupled between the P conductor, through contacts $63a_1$, $63b_1$, $63c_1$, $63d_1$, and to either one of the four auxiliary conductors 34.1, 34.2, 34.3, 34.4, which are mounted in parallel with the N conductor, through switches 68A, 68B, 68C, and 68D each comprising four parts numbered 1 to 4.

Contacts 60*a, b, c, d* are controlled from a remote control station shown at T comprising four switches T1, T2, T3, T4 and, more generally as many switches as they are auxiliary conductors 34.

Upon the closing of a switch Ti ($i = 1, 2, 3, 4$) the conductor 34.i is fed. The switches 60n ($n$ = A, B, C, D) coupled to switches 68n.i on the "ON" position are actuated and the corresponding lamps are put on. For instance, let us assume that $i = 1$, that switches $68a_1$ and $68b_1$ are "ON", that switches $68c_1$ and $68d_1$ are "OFF". Closing contact T1 results in putting ON lamps A and B only.

Various combinations are possible through various pre-setting of each of the four contacts of switches 68. The group of four pieces of equipment can thus be switched to $16^4$ possible combinations. Finally, once the main switch IG is closed, the remote-control apparatus has four contacts T1, T2, T3, T4 available for use with 16 possible combinations each. The enormous variety of possible combinations of "On" and "Off" settings, which depend on the repeatable settings of the switches and contacts, may thus be appreciated. A particular application of the invention relates to window displays where peoples' attention can be continually attracted by changes brought about from a distance.

The operation of the circuit shown in FIG. 20 is as follows: with the junction box 11 attached to the duct and the individual contacts of contactors conductively engaged with the respective power and auxiliary conductors of the duct, the lead P of FIG. 20 is directly connected to one conductor of the power line in the duct while lead N is connected through a switch to the other of the power line conductors. With the latter switch shown as IG closed and with switch 1 of the bank of switches 68A closed for example, closure of switch $T_1$ will energize the winding of relay 60A to close contacts 60*a* to connect one terminal of lamp A to lead N, the other terminal of the lamp being directly connected to the lead P so that it is energized. If switch 1 of any other one of the switch banks 68B–68D were closed, their respective relays would also be energized to in turn energize their respective lamps.

The above description is merely given as an illustration, and it will be understood that various modifications may be made without departing from the scope of the invention as defined in the appended claims. In particular, the number of auxiliary conductors for remote-control may be other than four.

I claim:

1. An electrical supply device comprising an elongated duct adapted for fixing to a support surface, said duct including a sheath of channel-shaped cross section having a flat back, a pair of opposed side walls and a front opening, at least one insulating member housed in said sheath along one side wall thereof, said insulating member being provided with longitudinally extending slots, and at least one detachable adaptor which is adapted to be inserted through the opening where required along the duct for providing mechanically supported power supply connections for a piece of electrical equipment, two power conveying conductors and a plurality of auxiliary conductors fitted in said slots, said adaptor housing two further power conveying conductors and a plurality of further auxiliary conductors and having contact means for connecting said further power-conveying and further auxiliary conductors to the respective power-conveying and auxiliary conductors fitted in the slots; electrically controllable switching means for controlling the connection of the two further power-conveying conductors housed in the adaptor to said equipment, said switching means having a control terminal; further switching means for selectively controlling the connection between the respective further auxiliary conductors and the control terminal of said switching means and means for selectively applying a control current to selected ones of the further auxiliary conductors, said contact means including at least one pivotable contactor having an axis which is perpendicular to the flat back of the sheath and is adapted for being fitted into the opening in the sheath, the said contactor having contact members adapted to be inserted simultaneously into the respective slots for making electrical connection with both the power-conveying and the auxiliary conductors when the contactor is pivoted.

2. An electrical supply device as claimed in claim 1, wherein the said further switching means include a push-button control switch between each of the auxiliary conductors to the adaptor and said control terminal.

3. An electric supply device as claimed in claim 1, wherein the said sheath has right and left front flanges of substantially different widths and each having an inwardly projecting upturned end portion, the sheath housing comprising a single insulating member which is retained therein by the wider of the said right and left flanges.

4. An electric supply device as claimed in claim 1, comprising a plurality of said duct sections and connector means for connecting the said duct sections together, said connector means including members having first and second pluralities of parallel extending flat contact members, the contact members of the first plurality being adapted to engage in a plug-in manner the respective conductors in a duct section, each of said connecting blocks comprising an assembly of stacked conducting plates and interleaved insulating plates, each having at least two flat projections, a pair of resilient end plates and a pair of outer housing-half parts, each of said insulating, conductive and resilient plates and housing-half parts having a central aperture, bolt means extending through the said apertures, said bolt means cooperating with said housing-half parts and said resilient plates for locking the stacked plates together, the contact members of the second plurality being adapted to engage in a plug-in manner the respective flat projections of the conducting plates in a connecting block.

* * * * *